US011536527B1

(12) United States Patent
Selph et al.

(10) Patent No.: US 11,536,527 B1
(45) Date of Patent: Dec. 27, 2022

(54) CARTRIDGE MAGAZINE LOADING OPTIMIZATION DEVICE

(71) Applicant: University of South Florida, Tampa, FL (US)

(72) Inventors: Stephen Edward Selph, Bradenton, FL (US); Andreas Daniel Niederer, Bradenton, FL (US); Cristofer Eliberto Jacinto-Garcia, Bradenton, FL (US)

(73) Assignee: UNIVERSITY OF SOUTH FLORIDA, Tampa, FL (US)

( * ) Notice: Subject to any disclaimer, the term of this patent is extended or adjusted under 35 U.S.C. 154(b) by 44 days.

(21) Appl. No.: 17/081,560

(22) Filed: Oct. 27, 2020

Related U.S. Application Data

(60) Provisional application No. 62/926,749, filed on Oct. 28, 2019.

(51) Int. Cl.
*F41A 9/83* (2006.01)

(52) U.S. Cl.
CPC ..... *F41A 9/83* (2013.01)

(58) Field of Classification Search
CPC ..... F41A 9/66; F41A 9/82; F41A 9/83
See application file for complete search history.

(56) References Cited

U.S. PATENT DOCUMENTS 4,879,829 A * 11/1989 Miller ..... F41A 9/83 42/87
9,354,008 B1 5/2016 Cifers et al.
9,612,072 B2 4/2017 Hochstrate
9,939,218 B2 4/2018 Mokuolu
11,125,518 B1 * 9/2021 Liu ..... F42B 33/002
2014/0109451 A1 * 4/2014 Beckman ..... F41A 9/83 42/6
2019/0226780 A1 * 7/2019 Slevin ..... F41A 9/83

FOREIGN PATENT DOCUMENTS

CN 208108916 U 4/2018
CN 109029066 A 8/2018
RU 2279625 C2 3/2004

OTHER PUBLICATIONS

"AF Loader—World's First Automated Speedloader for Handgun Magazines," TFB, Sep. 26, 2017.
"Butler Creek ASAP Electronic Magazine Loader Instruction Manual," Mar. 20, 2019, pp. 1-12.

* cited by examiner

*Primary Examiner* — J. Woodrow Eldred
(74) *Attorney, Agent, or Firm* — Quarles & Brady LLP

(57) ABSTRACT

An automated magazine loading device having an ammunition hopper adapted to receive a firearm cartridge and a conveyor coupled to the ammunition hopper. The conveyor is configured to transport the firearm cartridge to a projectile indexer located in proximity to the conveyor and the conveyor is configured to deposit the firearm cartridge into the projectile indexer in a first orientation. The projectile indexer is configured to reorient the firearm cartridge into a second orientation. The projectile indexer also includes a port for receiving a magazine therein. Finally, the automated magazine loading device includes an actuator for engaging the firearm cartridge and inserting the firearm cartridge into the magazine.

10 Claims, 14 Drawing Sheets

CARTRIDGE MAGAZINE LOADING OPTIMIZATION DEVICE

CROSS-REFERENCE TO RELATED APPLICATIONS

This application claims the benefit of and priority to U.S. Provisional Application Ser. No. 62/926,749, having the title "CARTRIDGE MAGAZINE LOADING OPTIMIZATION DEVICE," filed on Oct. 28, 2019, the disclosure of which is incorporated herein by reference in its entirety.

FIELD OF THE INVENTION

The present disclosure relates to a cartridge magazine for a firearm and more particularly, to a device for automatically loading cartridges into a cartridge magazine.

BACKGROUND

Both semi-automatic and fully automatic firearms, such as various pistols and rifles, often utilize detachable cartridge magazines for storing ammunition and feeding the firearm. Instead of loading only one cartridge at a time into a firearm (or even a few cartridges), cartridge magazines evolved in order to permit a user to load and fire multiple cartridges from the firearm without having to stop and reload the firearm after discharging a relatively low number of cartridges. The use of firearm cartridge magazines also permits a user to carry magazines, which are loaded with multiple cartridges, instead of carrying loose cartridges. As such, a user can more efficiently store and reload the firearm. Enumerable cartridge magazines have been created and utilized; however, the most commonly used magazines today are known as detachable box magazines.

Box magazines became popular after World War II, and today, most semi-automatic firearms, like the AR-15 rifle, utilize box magazines to store ammunition and consecutively/sequentially relay the cartridges into the powder chamber of the firearm. There are many types and configurations of cartridge magazines, but generally, box magazines are adapted to hold anywhere from a few rounds of ammunition to many dozens or more. The cartridges are typically loaded by hand, one at a time, and positioned in one or more columns within the interior of the magazine. The process of hand loading cartridge magazines, one at a time, can be incredibly arduous and time consuming. Moreover, wounded veterans often suffer from limb loss or have reduced hand or limb function, which prevents or reduces such a user's ability to hand load a magazine for use with popular firearms. Thus, improvements that provide for an automated loading process for firearm cartridge magazines are needed.

SUMMARY OF INVENTION

In one aspect, the present disclosure includes an automated magazine loading device having an ammunition hopper adapted to receive a firearm cartridge and a conveyor coupled to the ammunition hopper. The conveyor is configured to transport the firearm cartridge to a projectile indexer located in proximity to the conveyor and the conveyor is configured to deposit the firearm cartridge into the projectile indexer in a first orientation. The projectile indexer is configured to reorient the firearm cartridge into a second orientation. The projectile indexer also includes a port for receiving a magazine therein. Finally, in this aspect, the automated magazine loading device includes an actuator for engaging the firearm cartridge and inserting the firearm cartridge into the magazine.

In another aspect, the present disclosure includes an automated ammunition loading device comprising a hopper configured to receive a first firearm cartridge oriented in a first orientation and a second firearm cartridge oriented in a second orientation, and wherein the automated ammunition loading device reorients the first and second firearm cartridges into a third orientation.

In still another aspect, the present disclosure includes an automated ammunition loading device for loading firearm cartridges into a magazine. The device has a hopper that is configured to receive a first firearm cartridge having a first orientation and a second firearm cartridge having a second orientation. The device also has a projectile indexer that is coupled to the hopper and configured to receive the first and second firearm cartridges therein and reorients the first and second firearm cartridges into a third position. The device also includes a loading bay for receiving a magazine therein. Finally, the device, in this aspect, also includes an actuator that is configured to insert the first and second firearm cartridges into the magazine when the first and second cartridges have been oriented into the third position.

These and many other aspects of the present disclosure are discussed below.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
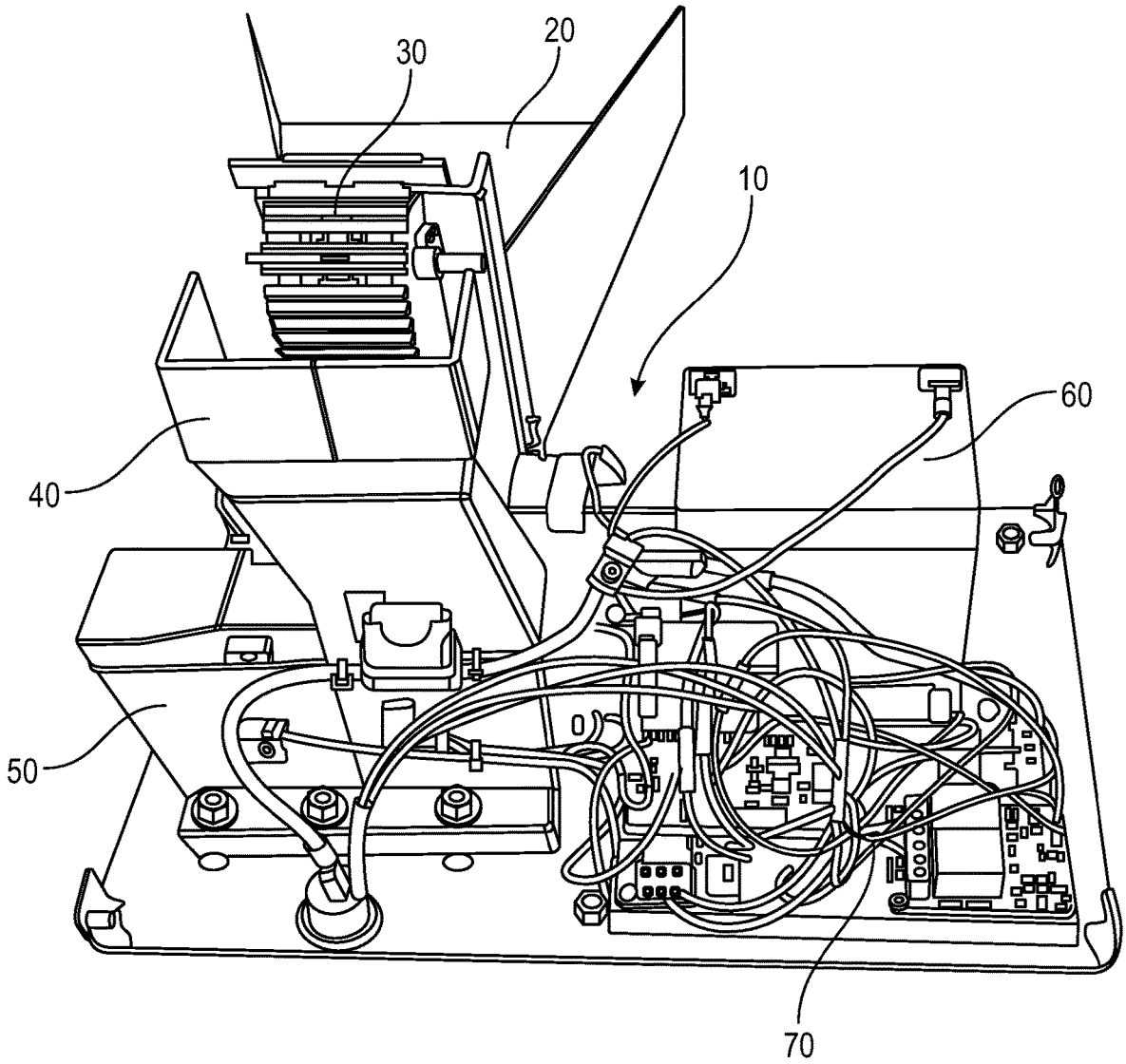
FIG. 1 is a photograph of an exemplary cartridge loading optimization device in accordance with various embodiments of the present disclosure.
Figure 2:
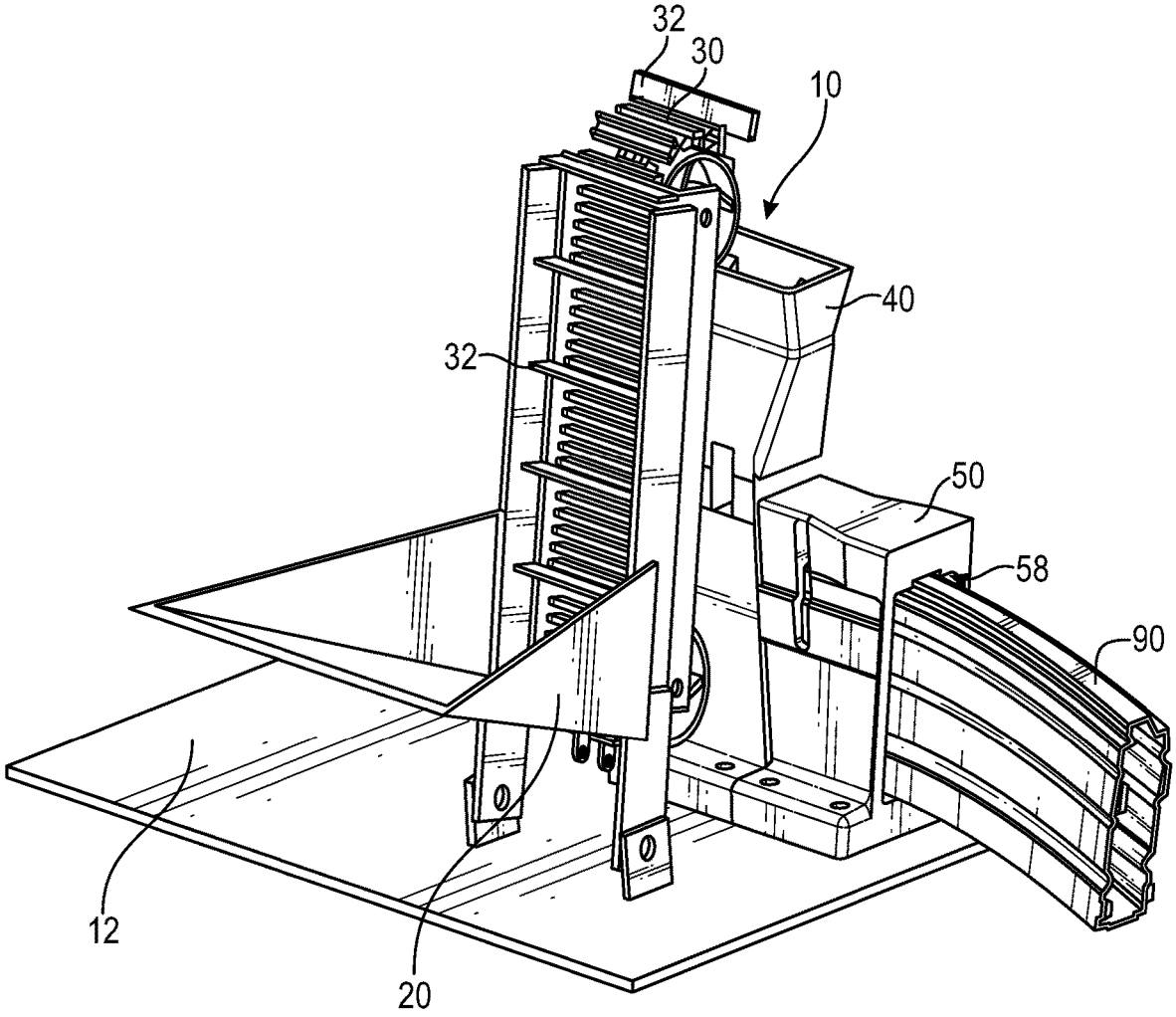
FIG. 2 is a perspective view of the cartridge loading optimization device in accordance with various embodiments of the present disclosure.

In accordance with the present disclosure, embodiments of a firearm cartridge magazine loading optimization device are presented. Generally, the firearm cartridge magazine loading optimization device, as presented in the various embodiments described herein, is a device for automatically loading cartridges into magazines and eliminates the need for a user to hand load the same. FIGS. 1-2 depicts a magazine loading device 10 according to a first example embodiment of the present disclosure. As detailed in FIG. 1, the magazine loading device 10 generally includes an ammunition hopper 20, elevator conveyer 30, projectile indexer 40, load bay 50, battery source 60, and logic board 70. The example embodiment depicted in FIGS. 1-2 is configured to receive ammunition designed for the AR-15 rifle, such as 223 Remington and/or 5.56 NATO, but in alternative embodiments, the magazine loading device of the present disclosure can be configured to receive any other type/size of ammunition or can be configured to accept and operate with any other weapons platform (such as AK-47, other rifles, pistols, or shotguns).

Figure 3:
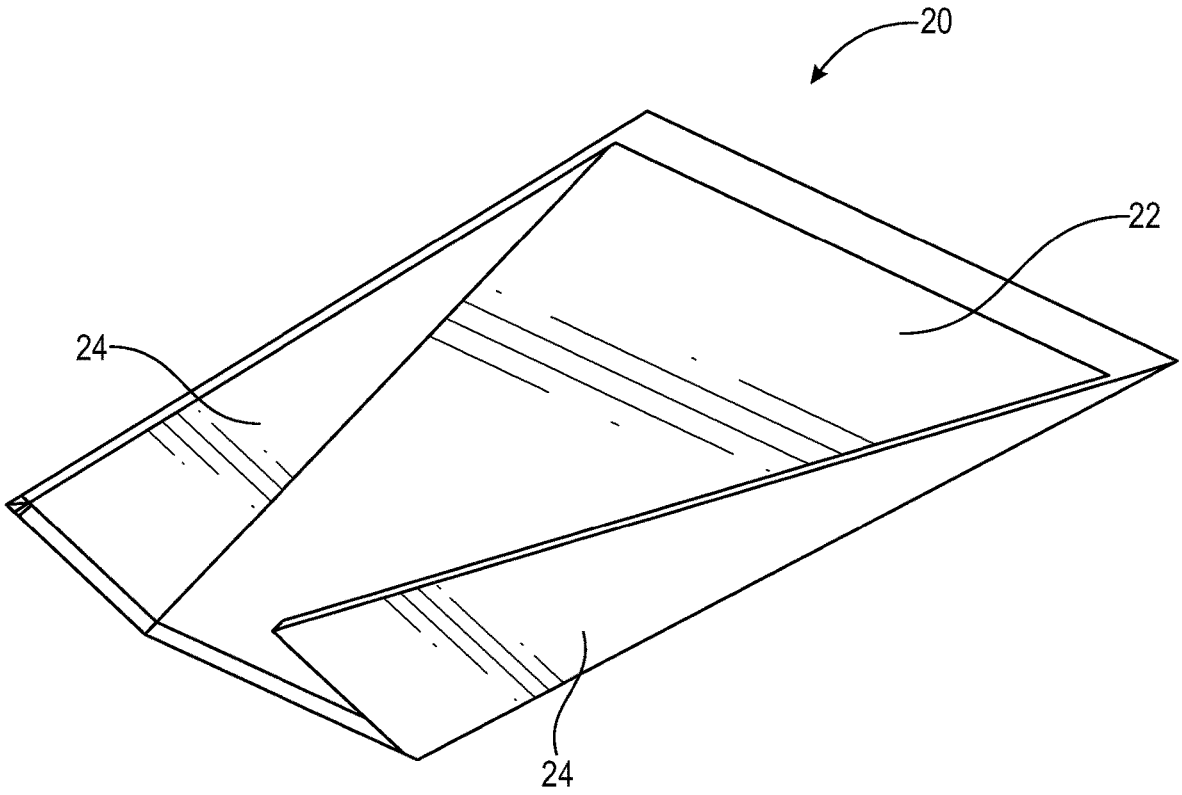
FIG. 3 is a perspective view of an ammunition hopper component of the cartridge loading optimization device of FIG. 2.

As shown in FIGS. 1-2, an exemplary magazine loading device 10 includes an ammunition hopper 20 for receiving cartridges. A user utilizing the exemplary magazine loading device 10, can insert a quantity of cartridges into the ammunition hopper 20. In particular, the ammunition hopper 20 can receive the load ammunition in various quantities and no specific orientation of the cartridges is required when loading the ammunition. For instance, a user can simply open a container of ammunition and pour the cartridges into the ammunition hopper 20 without regard to quantity or orientation. The ammunition hopper 20 is coupled to the elevator conveyor 30 and is preferably oriented at an angle Al such that the loaded ammunition slides along a slide surface 22 (best seen in FIG. 3) via gravity toward the elevator conveyor 30. In example embodiments, angle Al is less than 90 degrees from vertical, and in alternative example embodiments, angle Al is less than 75 degrees from vertical. The slide surface 22 in exemplary embodiments includes rails 24 to prevent cartridges from escaping the ammunition hopper 22 and to help funnel the cartridges towards the elevator conveyor 30. Optionally, the rails 24 can also agitate the cartridges in the hopper 20 to help facilitate the self-loading nature of the cartridges into the conveyor 30. In commercial example embodiments, the ammunition hopper is made from metal (such as aluminum or steel, or variations thereof) but can alternatively be constructed from plastic, polymers, wood, rubber, other metals, or as otherwise desired by a user.

Figure 4:
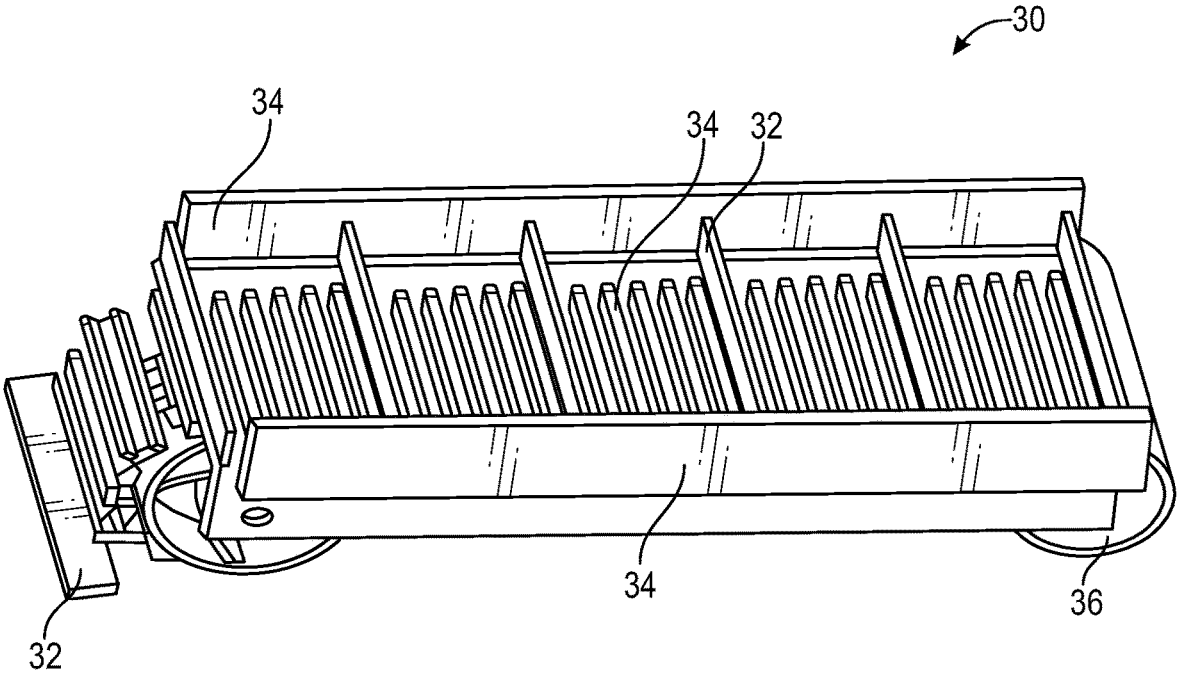
FIG. 4 is a perspective view of an elevator conveyor component of the cartridge loading optimization device of FIG. 2.

In example embodiments, the elevator conveyor 30 is affixed to a base 12 and rises at a perpendicular, or substantially perpendicular, orientation therefrom. The elevator conveyor is motor-driven to transport the cartridges in the ammunition hopper 20 to the projectile indexer 40 and includes one or more fins 32 positioned along the circumference of the conveyor to engage and lift the cartridges from the ammunition hopper 20 to the projectile indexer 40, as shown in FIGS. 1-2 and 4. In example embodiments, the fins 32 are sized to receive a particular cartridge size (e.g., AR-15 ammunition) and are removably coupled into place along the conveyor 30. In example commercial embodiments, the fins 32 are clipped into place, but alternative known coupling methods can be used to removably affix the fins to the conveyor 30. Additionally, a user can utilize any number of fin sizes/shapes (e.g., having various lengths and/or widths), such that the magazine loading device 10 is modular and can be configured to receive various types of ammunition having alternative shapes and sizes (for instance, pistol cartridges, shotgun cartridges, or various other types of rifle cartridges). In still other alternative embodiments, the fins 32 can be permanently affixed to the conveyor 30. The elevator conveyor 30 also can include side rails 34 (as best seen in FIG. 4) for containing and restricting the cartridges along the carrying surface 36 of the elevator conveyor 30. The elevator conveyor 30 lifts the cartridges, one at a time, from the ammunition hopper 20 and deposits each of them in the projectile indexer 40.

Figure 5:
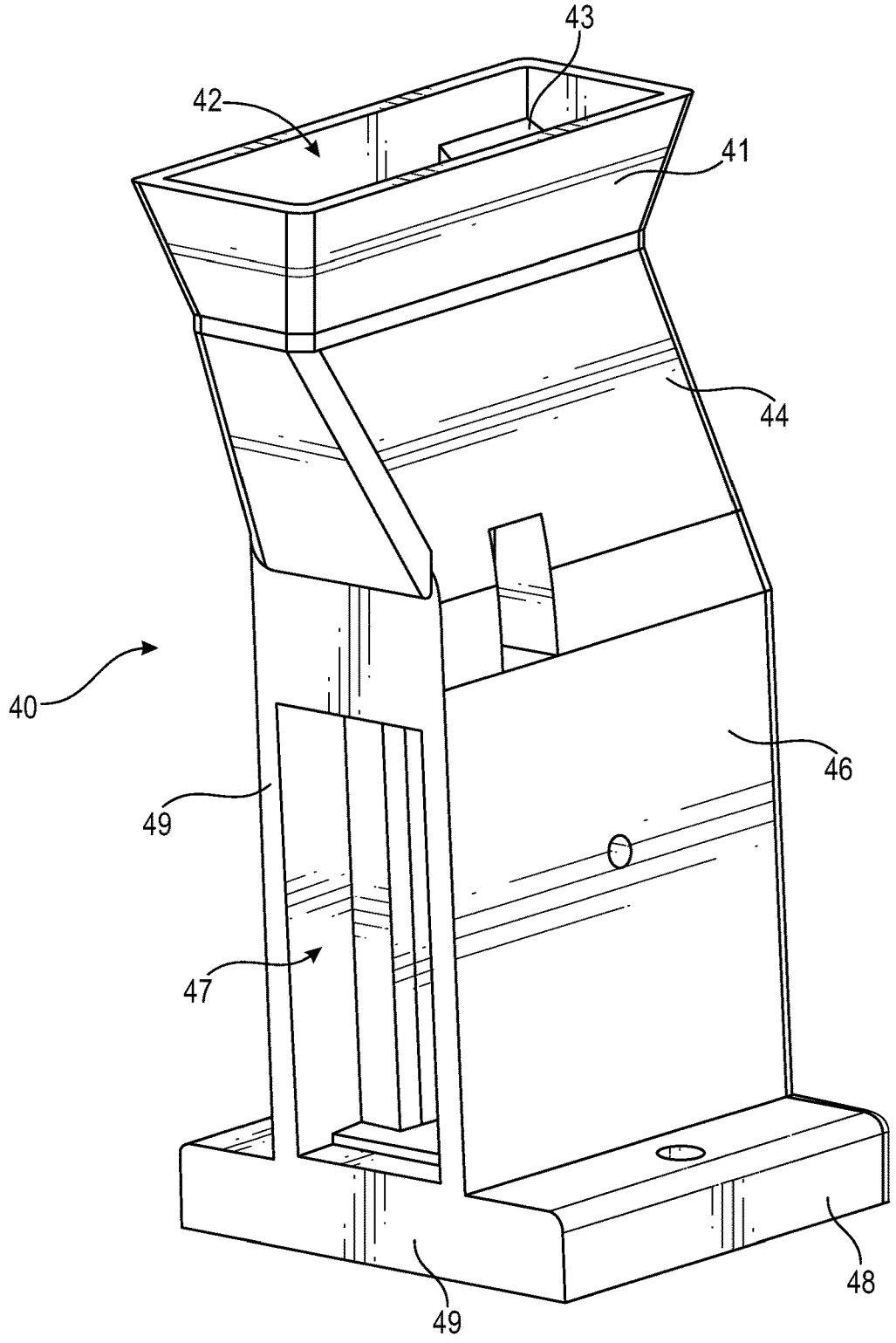
FIG. 5 is a perspective view of a projectile indexer component of the cartridge loading optimization device of FIG. 2.
Figure 5A:
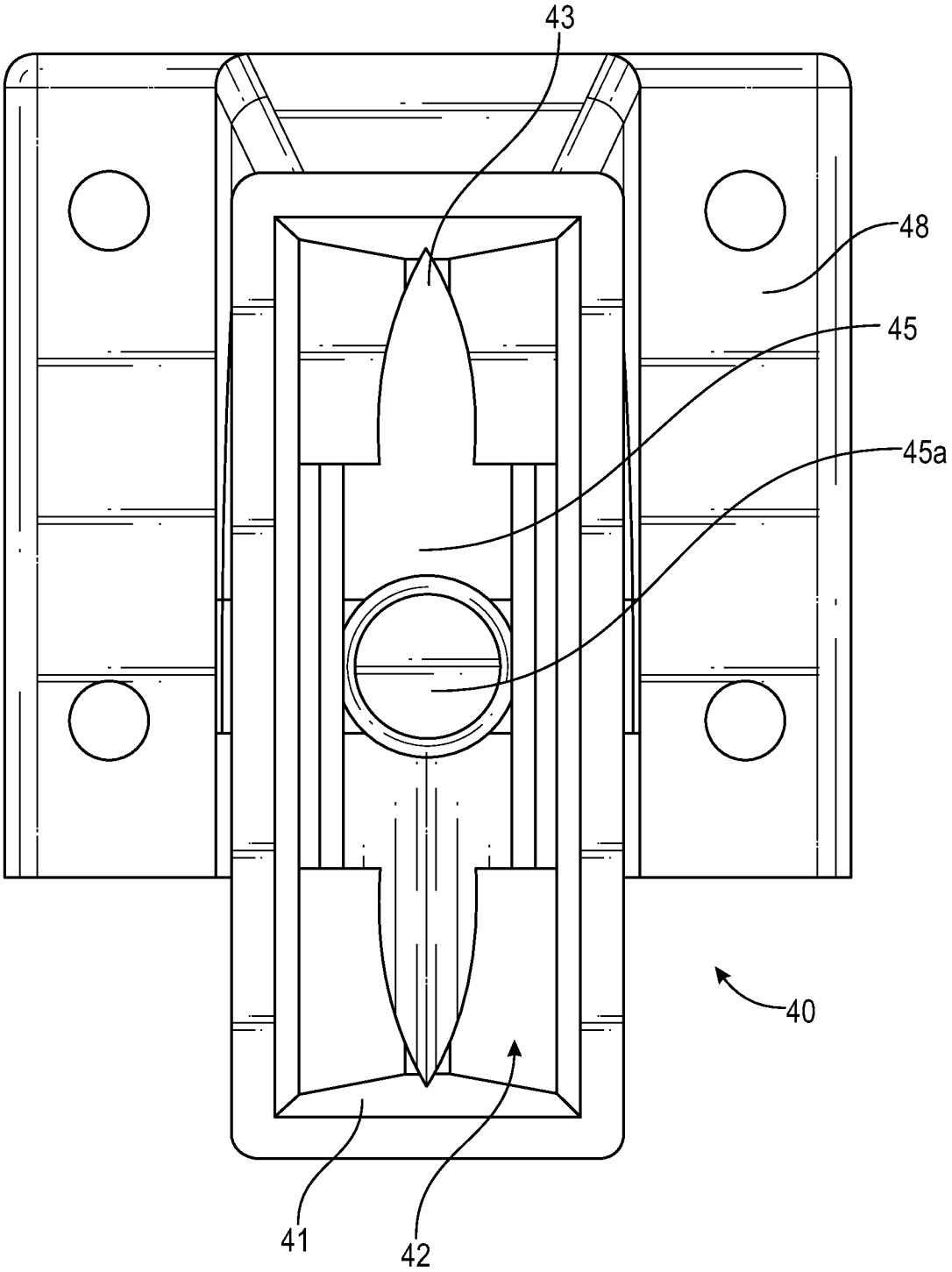
FIG. 5*a* is a plan view of the projectile indexer component of FIG. 5.
Figure 5B:
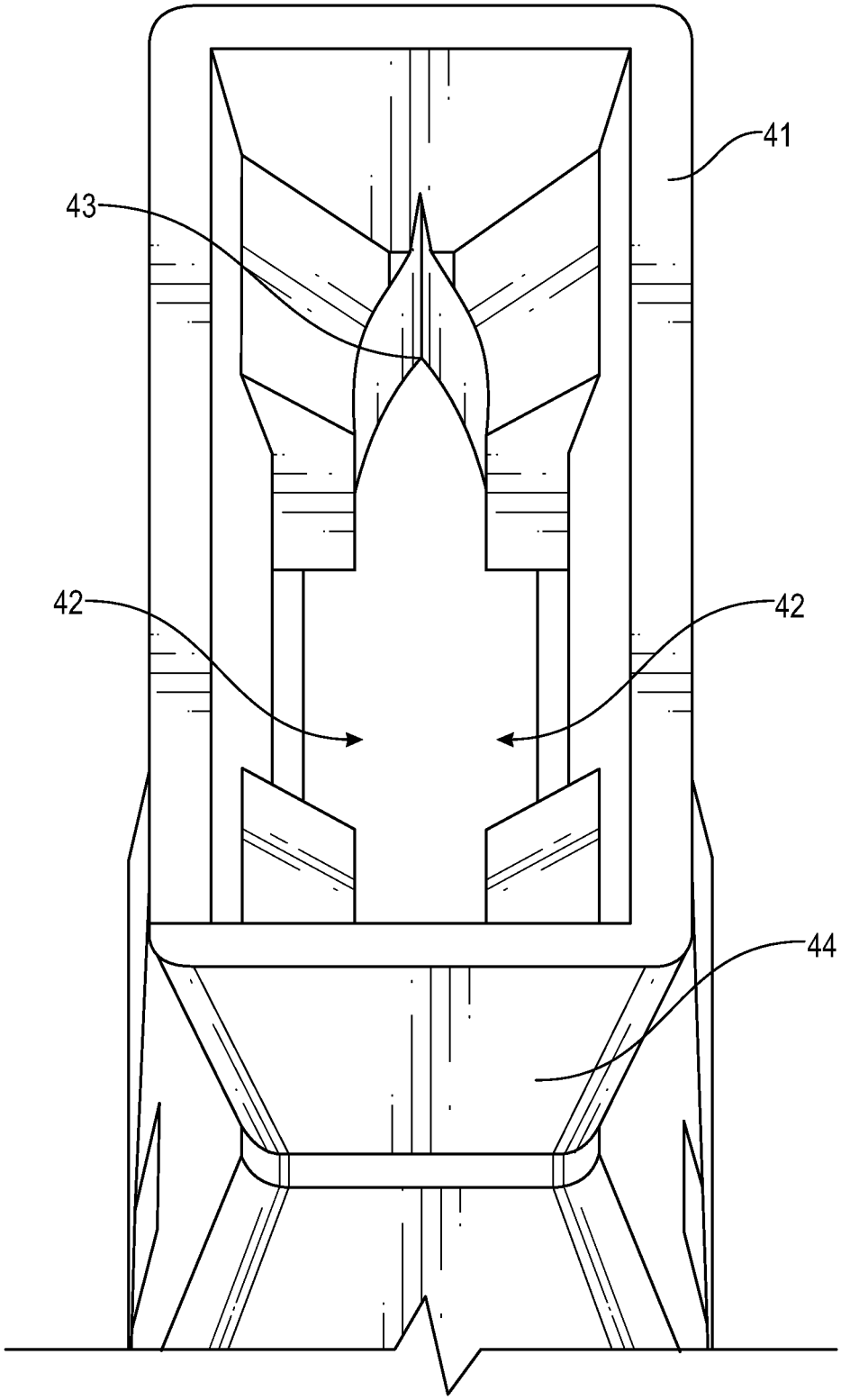
FIG. 5*b* is a top perspective view of the projectile indexer component of FIG. 5.
Figure 5C:
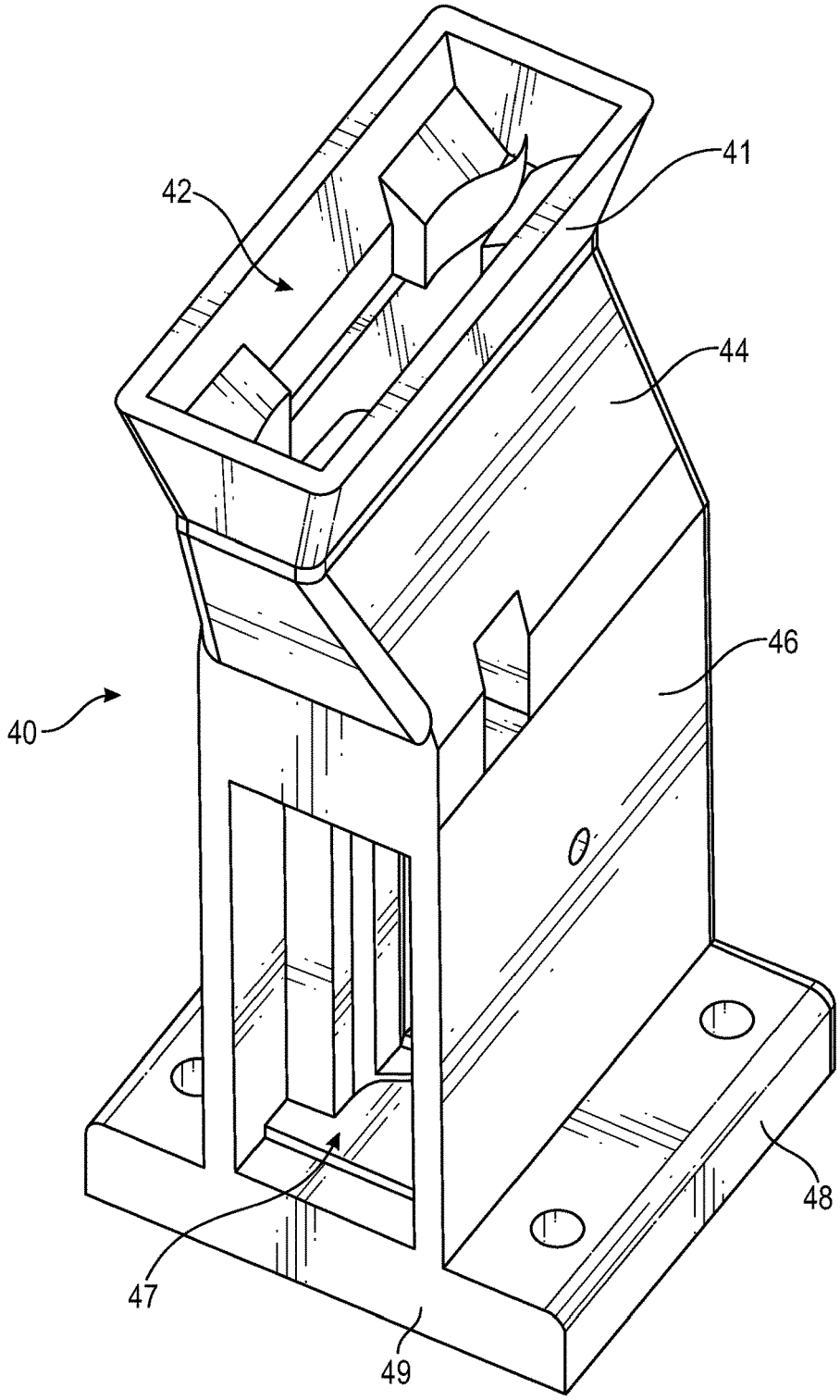
FIG. 5*c* is another perspective view of the projectile indexer component of FIG. 5.
Figure 9:
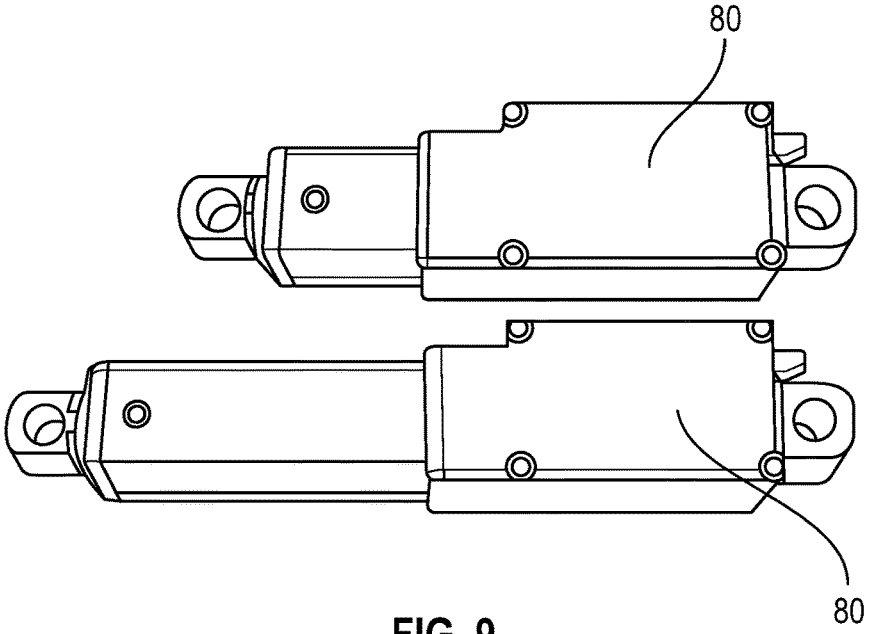
FIG. 9 is an example actuator for use in connection with the cartridge loading optimization device of FIG. 2.

An exemplary projectile indexer 40, as best seen in FIGS. 1-2 and 5, is coupled to the base surface 12 via its indexing base 48 and is adapted to receive the cartridges from the elevator conveyor 30 as they are carried away from the ammunition hopper 20. When a cartridge reaches the top of the elevator conveyor 30, it is deposited into projectile indexer 40 via the uppermost opening 42 of the projectile indexer's indexing tray 41. As best seen in FIGS. **5*a*-5*c*, once inside the projectile indexer 40, the cartridges pass through a slot 43 having the general shape of the particular cartridge that the magazine loading device 10 is configured to receive. For instance, if the magazine loading device 10 is configured to receive 223 Remington, the projectile indexer 40 can include an indexing tray 41 that includes a slot 43 that generally mirrors the bullet shape of the 223 Remington cartridge and sized such that an actual 223 Remington cartridge can pass therethrough, regardless of the orientation of the cartridge when it is deposited into the indexing tray 42. As best seen in FIG. 5*a*, in example embodiments, the slot 43 has bullet shaped openings at each end to permit a cartridge to slide through the slot in a bullet-down orientation before sliding through an opening 45*a* in a bottom 45 of the feed chute 44 and into the actuator housing 46. The projectile indexer 40 includes a cavity 47 adapted for receiving a magazine therein. The projectile indexer 40 also includes a mating surface 49 for removably engaging the load bay 50. In example embodiments, the actuator housing 46 encloses one or more actuators 80 (example actuators seen in FIG. 9**) for engaging the cartridge and pushing each individual cartridge into a magazine, which is removably coupled thereto.

Figure 6:
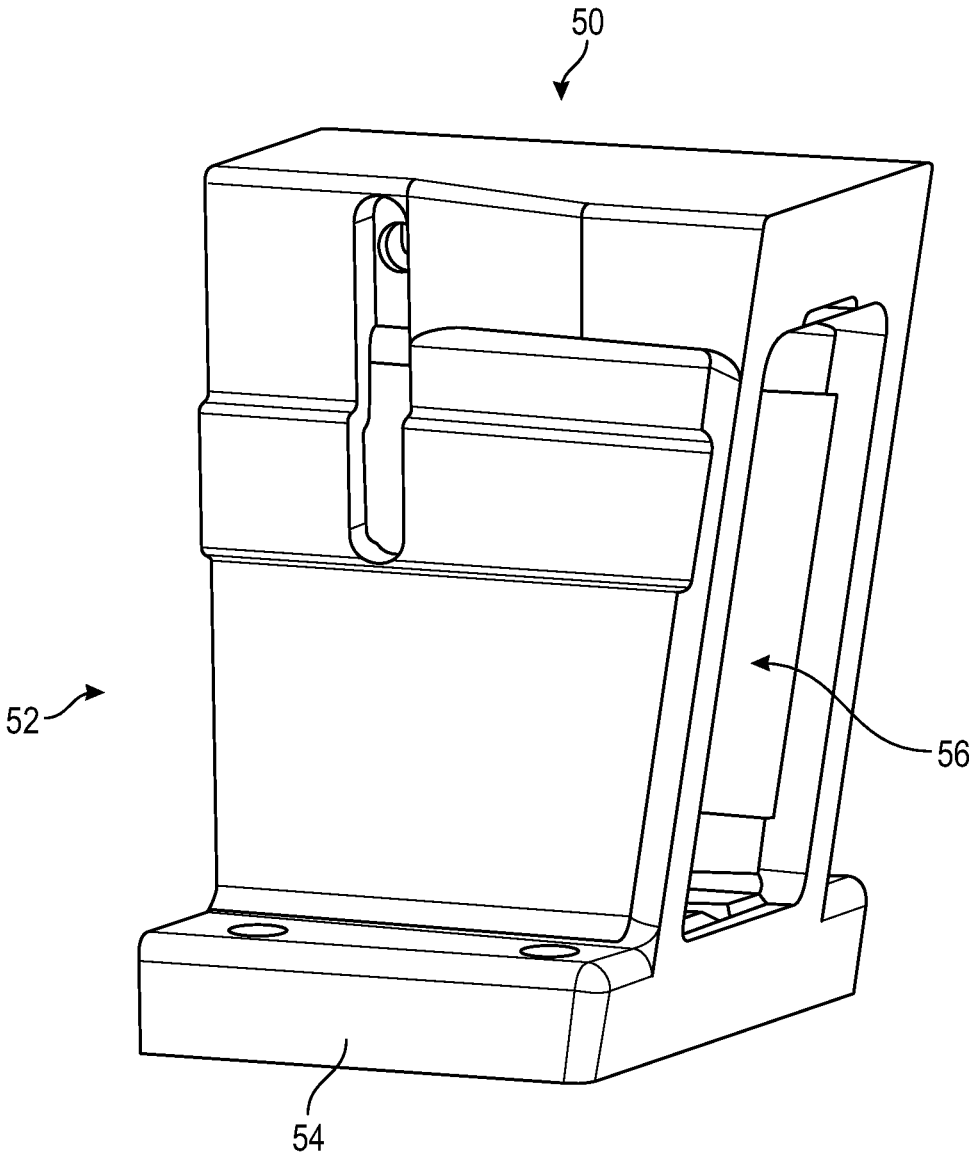
FIG. 6 is a perspective view of a load bay component of the cartridge loading optimization device of FIG. 2.

In example embodiments the load bay 50 is proximally located near the projectile indexer 40, and in particular, the mating surface 49 of the projectile indexer generally abuts the adjoining surface 52 of the load bay. As best seen in FIGS. 1-2 and 6, the load bay 50 includes a mounting base 54 for affixing the load bay to the base surface 12 and positionally securing the load base in relation to the projectile indexer. In this orientation, the cavity 47 of the projectile indexer 40 is aligned with a corresponding cavity 56 in the load bay, and collectively, the two aligned cavities create a receiving port 58 for receiving and temporarily securing a firearm magazine, such as the AR-15 magazine 90 depicted in FIG. 7. In example embodiments, the load bay 50, actuator housing 46, projectile indexer 40 and tray 41 are interchangeable to accommodate a wide variety of firearm platforms and cartridges types/sizes. Example embodiments described herein that are directed towards receiving ammunition for an AR-15 rifle are merely exemplary.

Figure 8:
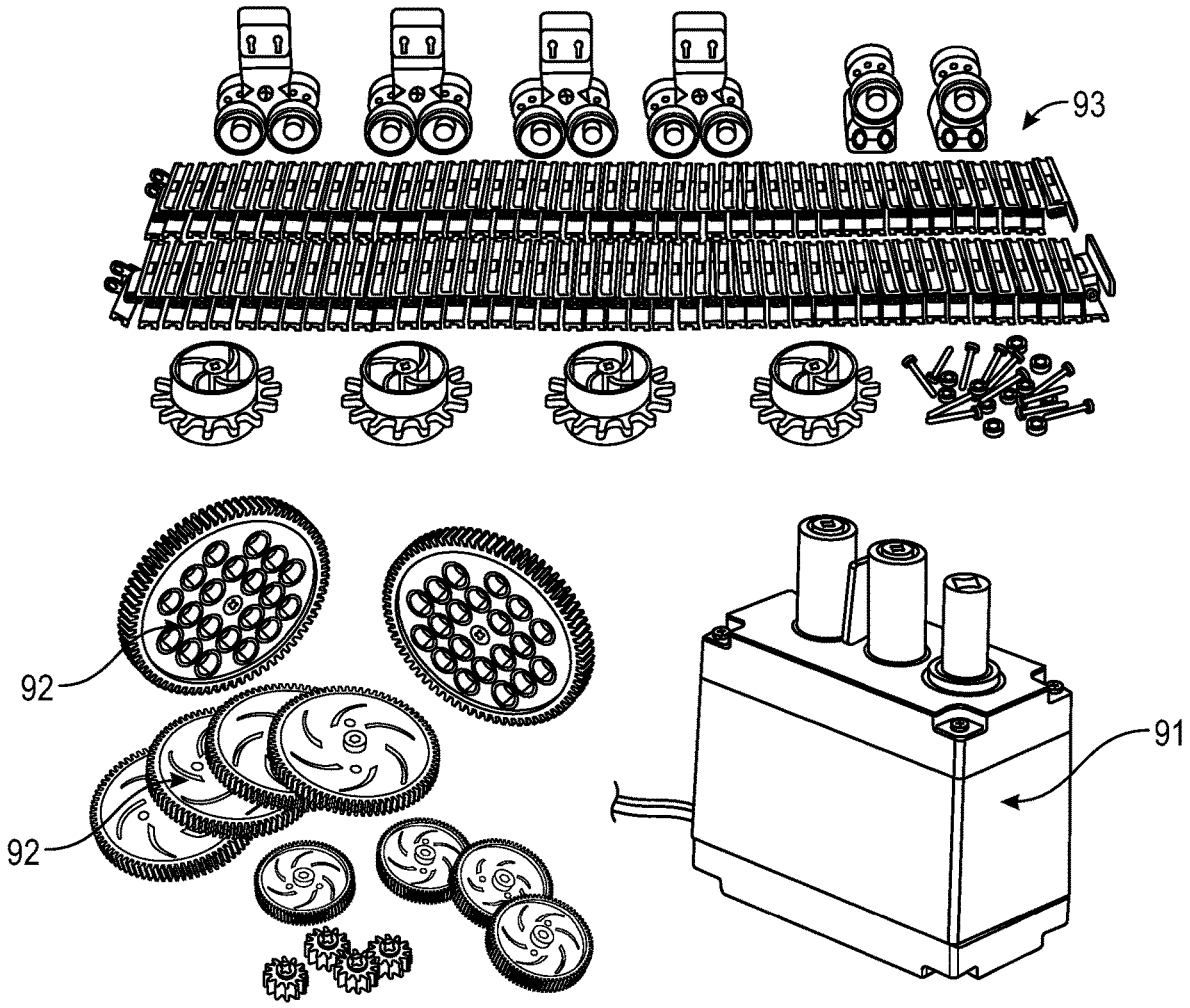
FIG. 8 depicts example auxiliary components used in connection with cartridge loading optimization device of FIG. 2.
Figure 10:
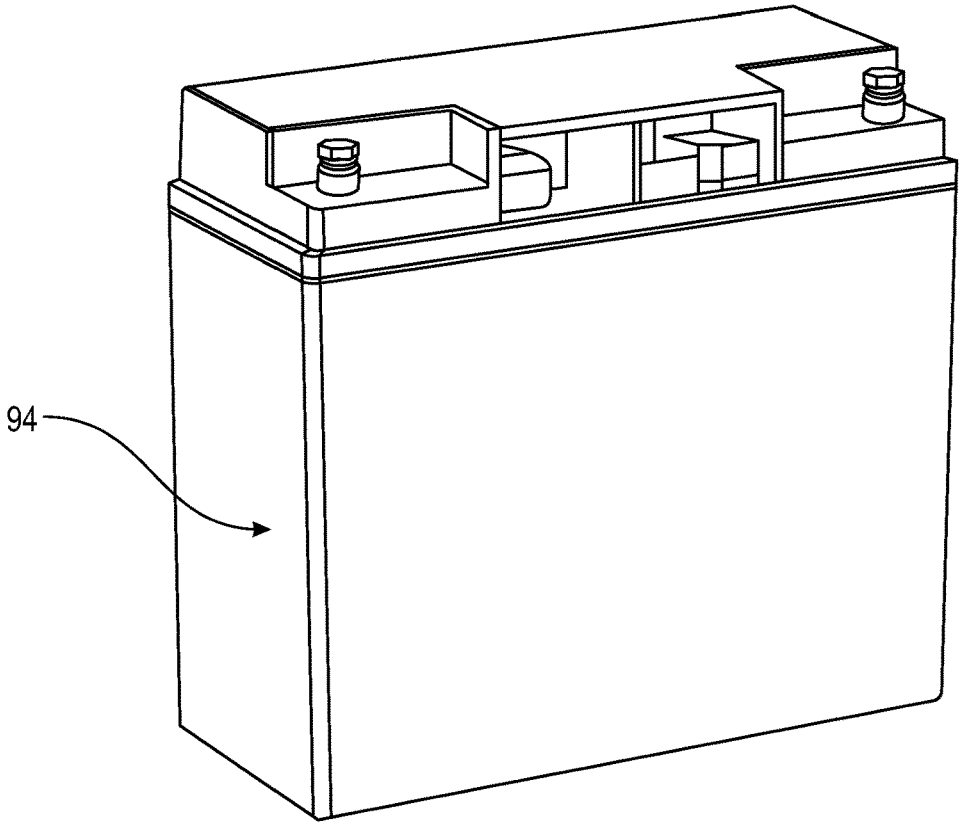
FIG. 10 is an example battery for use in connection with the cartridge loading optimization device of FIG. 2.
Figure 11:
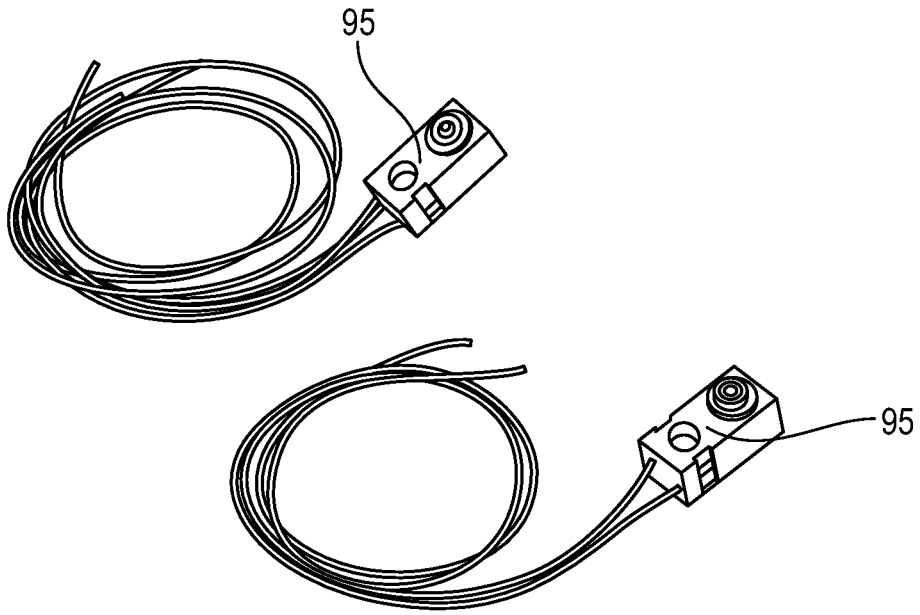
FIG. 11 are depictions of example sensors for use in connection with the cartridge loading optimization device of FIG. 2.
Figure 12:
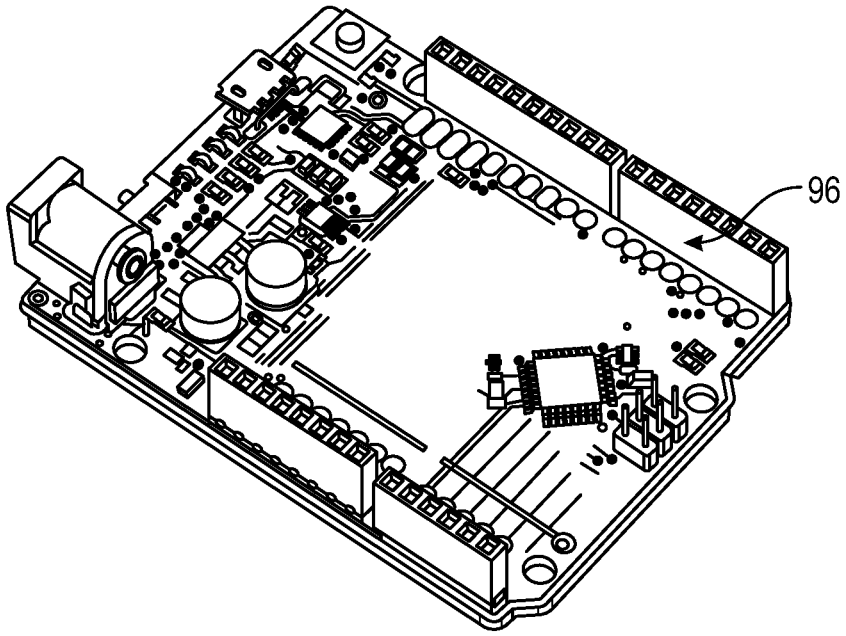
FIG. 12 is an example logic board for use in connection with the cartridge loading optimization device of FIG. 2.
Figure 13:
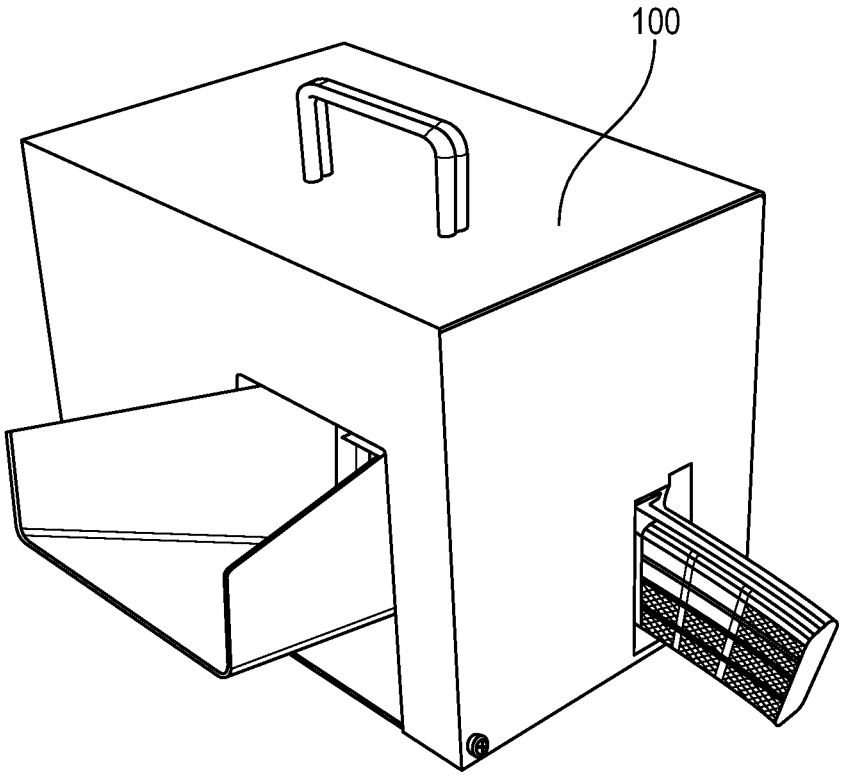
FIG. 13 depicts an example housing for use in connection with the cartridge loading device of FIG. 2.

Additional components used in connection with example embodiments of the present disclosure are depicted in FIGS. 8 and 10-12. For instance, FIG. 8 depicts exemplary components from Vex Manufacturing, such as, but not limited to, example electric motors 91, example gears 92, and example tread kits 93. FIG. 10 depicts an example battery 94, which in example embodiments is a sealed lead acid battery used to power all electrical components of the magazine loading device 10. FIG. 11 depicts example sensors 95 for use with the indexing tray 41 to prevent more than one cartridge from being loaded in the tray at one time. In example embodiments, the sensors used in connection with example embodiments of the present disclosure are infrared break beam sensors. FIG. 12 is an example logic board 96 for use with example embodiments according to the present disclosure, which contains all programming logic to control the operation of the magazine loading device 10. Finally, a housing 100 can be used to cover the at least a portion of the working components of the magazine loading device 10 as seen in FIG. 13.

Figure 7:
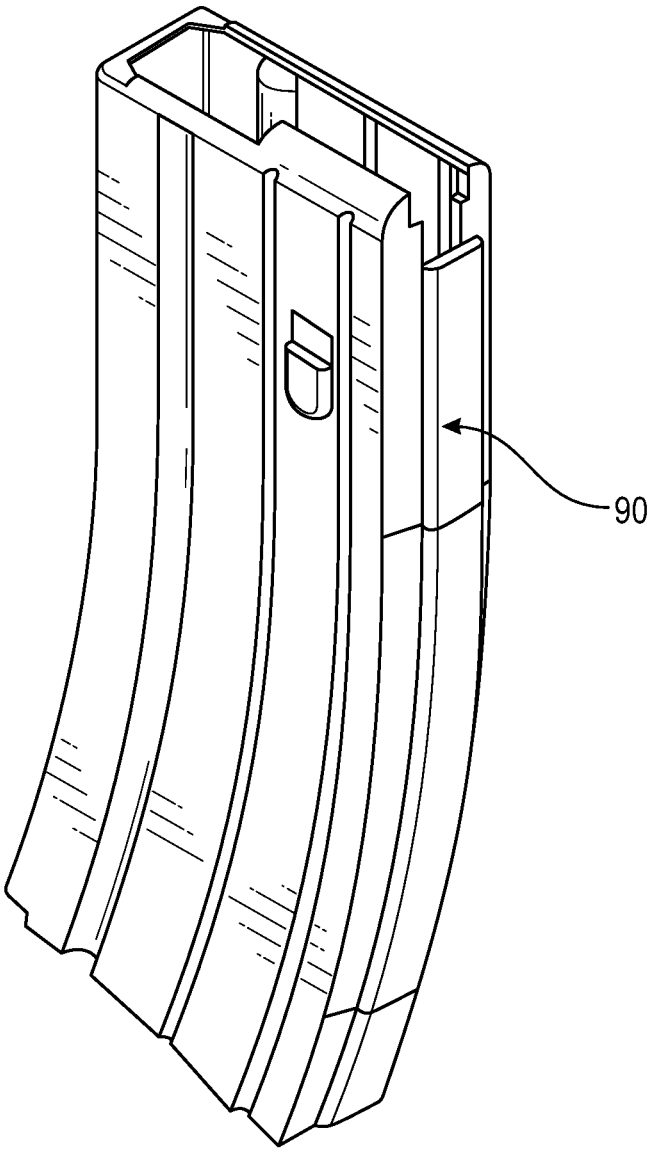
FIG. 7 is a known firearm cartridge magazine for use in conjunction with the cartridge loading optimization device of FIG. 2.

In operation, example embodiments of the magazine loading device 10 according to the present disclosure can be operated in the following sequence. First, a user can insert and orient a magazine, such as the example magazine 90 as depicted in FIG. 7, into the receiving port 58. Then, a user can place the desired ammunition into the ammunition hopper 20 and can power on the machine by connecting the power source to the motor (this can be accomplished mechanically or by utilizing an on/off switch) and allowing the elevator conveyor 30 to ferry cartridges towards the projectile indexer 40. As soon as the first cartridge is deposited into the projectile indexer 40 via the indexing tray 41, the elevator conveyor 30 is temporarily halted until the first cartridge has been inserted into the magazine so as not to jam the magazine loading device 10. The aforementioned temporary halting of the elevator conveyor can be accomplished either mechanically by the user/operator or automatically via one or more sensors, such as those sensors 95 depicted in FIG. 11. Once the cartridge has been indexed by the projectile indexer 40 and is oriented in the correct direction, an actuator (such as, for example, the one depicted in FIG. 9) engages the cartridge and loads the same into the magazine. The magazine is sequentially loaded in this fashion until the magazine is full, at which time, the user can switch out a full magazine for an empty magazine and restart the process.

It should be emphasized that the above-described embodiments of the present disclosure are merely possible examples of implementations, merely set forth for a clear understanding of the principles of the disclosure. Many variations and modifications may be made to the above-described embodiment(s) without departing substantially from the principles of the disclosure. All such modifications and variations are intended to be included herein within the scope of this disclosure and protected by the following claims.

The invention claimed is:

1. An automated magazine loading device comprising:

an ammunition hopper adapted to receive a firearm cartridge;

a conveyor coupled to the ammunition hopper, the conveyor configured to transport the firearm cartridge to a projectile indexer located in proximity to the conveyor, wherein the conveyor is configured to deposit the firearm cartridge into the projectile indexer in a first orientation in which the firearm cartridge was received by fins of the conveyor, wherein the projectile indexer is configured to reorient the firearm cartridge into a second orientation that is perpendicular to the first orientation so that a bullet of the firearm cartridge is directed down toward a hole in the projectile indexer; and wherein the projectile indexer includes a port for receiving a magazine therein; and an actuator for engaging the firearm cartridge and inserting the firearm cartridge into the magazine.

2. The automated magazine loading device of claim 1, further comprising a load bay in proximity to at least a portion of the projectile indexer, wherein the load bay at least partially secures the magazine to the automated magazine loading device.

3. The automated magazine loading device of claim 2, wherein the conveyor is an elevator conveyor.

4. The automated magazine loading device of claim 3, wherein the elevator conveyor lifts the firearm cartridge from the ammunition hopper and releases the firearm cartridge into the projectile indexer.

5. An automated ammunition loading device for loading firearm cartridges into a magazine comprising:

a conveyor configured to receive a first firearm cartridge oriented in a first direction or a second direction;

a projectile indexer operably coupled to the conveyor, the projectile indexer configured to receive the first firearm cartridge therein and reorient the first firearm cartridge into a third direction that is perpendicular to the first direction and the second direction so that a bullet of the first firearm cartridge is directed down toward a hole in the projectile indexer;

a loading bay adapted to receive a magazine; and an actuator configured to insert the first firearm cartridge into the magazine when the first firearm cartridge is in the third direction.

6. The automated ammunition loading device of claim 5, further comprising a hopper, wherein the conveyor is configured to transport the first firearm cartridge from the hopper to the projectile indexer.

7. The automated ammunition loading device of claim 5, wherein the conveyor is motor driven.

8. The automated ammunition loading device of claim 5, wherein the conveyor is an elevator conveyor.

9. The automated ammunition loading device of claim 6, wherein the hopper is further configured to receive a second firearm cartridge, wherein the first firearm cartridge has a first length and the second firearm cartridge has a second length, and wherein the conveyor has a first configuration operable to transport the first firearm cartridge to the projectile indexer and a second configuration operable to transport the second firearm cartridge to the projectile indexer.

10. The automated ammunition loading device of claim 9, wherein the first firearm cartridge is a pistol cartridge and the third firearm cartridge is a rifle cartridge.

* * * * *